US010185246B2

(12) United States Patent
Fukuno et al.

(10) Patent No.: US 10,185,246 B2
(45) Date of Patent: Jan. 22, 2019

(54) POWDER MATERIAL STORAGE CONTAINER AND IMAGE FORMING APPARATUS

(71) Applicant: FUJI XEROX CO., LTD., Tokyo (JP)

(72) Inventors: Ryo Fukuno, Kanagawa (JP); Yasutomo Ishii, Kanagawa (JP); Keisuke Kubo, Kanagawa (JP); Kenjo Nagata, Kanagawa (JP); Toshiaki Suzuki, Kanagawa (JP); Daisuke Uchimitsu, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,791

(22) Filed: Sep. 8, 2017

(65) Prior Publication Data

US 2018/0203380 A1 Jul. 19, 2018

(30) Foreign Application Priority Data

Jan. 16, 2017 (JP) ..... 2017-004991

(51) Int. Cl.
*G03G 15/08* (2006.01)

(52) U.S. Cl.
CPC ..... *G03G 15/0868* (2013.01); *G03G 15/0872* (2013.01); *G03G 15/0879* (2013.01)

(58) Field of Classification Search
CPC ..... G03G 15/0839; B65D 83/06
See application file for complete search history.

(56) References Cited

U.S. PATENT DOCUMENTS 5,918,095 A * 6/1999 Huang ..... G03G 15/0868 222/DIG. 1
2011/0058857 A1* 3/2011 Hori ..... G03G 15/0867 399/262

FOREIGN PATENT DOCUMENTS

JP 2006-171105 A 6/2006
JP 2013-37310 A 2/2013

* cited by examiner

*Primary Examiner* — Walter L Lindsay, Jr.
*Assistant Examiner* — Arlene Heredia
(74) *Attorney, Agent, or Firm* — Sughrue Mion, PLLC

(57) ABSTRACT

A powder material storage container includes: a cylindrical body member that extends in one direction and includes a storage chamber for storing powder material; a transport member that transports the powder material to an end of the storage chamber; a cylindrical end member that is attached to the body member, extends in the one direction and includes a passage chamber through which the powder material is passed, and a discharge outlet through which the powder material is discharged; a pillar member that is disposed in the passage chamber, extending in the one direction, and rotates in a circumferential direction of the passage chamber along the wall surface, and transports the powder material adhering to the wall surface to the discharge outlet; and a beam member that is laid across the discharge outlet and extends from an upstream side to a downstream side of a rotation direction of the pillar member.

10 Claims, 16 Drawing Sheets

64
64A
76
T1
T2
T
84
86
88
52
H
D

POWDER MATERIAL STORAGE CONTAINER AND IMAGE FORMING APPARATUS

CROSS-REFERENCE TO RELATED APPLICATIONS

This application is based on and claims priority under 35 USC 119 from Japanese Patent Application No. 2017-004991 filed on Jan. 16, 2017.

BACKGROUND

Technical Field

The present invention relates to a powder material storage container and an image forming apparatus.

SUMMARY

According to an aspect of the invention, there is provided a powder material storage container including: a body member that has a cylindrical shape extending in one direction and that includes a storage chamber in which powder material is stored; a transport member that transports the powder material stored in the storage chamber of the body member to an end of the storage chamber; an end member that is attached to an end of the body member, and that has a cylindrical shape extending in the one direction and includes a passage chamber through which, the powder material transported by the transport member to be discharged to an outside, is passed, and a discharge outlet which is formed in a wall surface of the passage chamber and through which the powder material is discharged to an outside; a pillar member that is disposed in the passage chamber and extends in the one direction, and that rotates in a circumferential direction of the passage chamber along the wall surface of the passage chamber, and transports the powder material adhering to the wall surface of the passage chamber to the discharge outlet; and a beam member that is laid across the discharge outlet and extends from an upstream side to a downstream side of a rotation direction of the pillar member.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
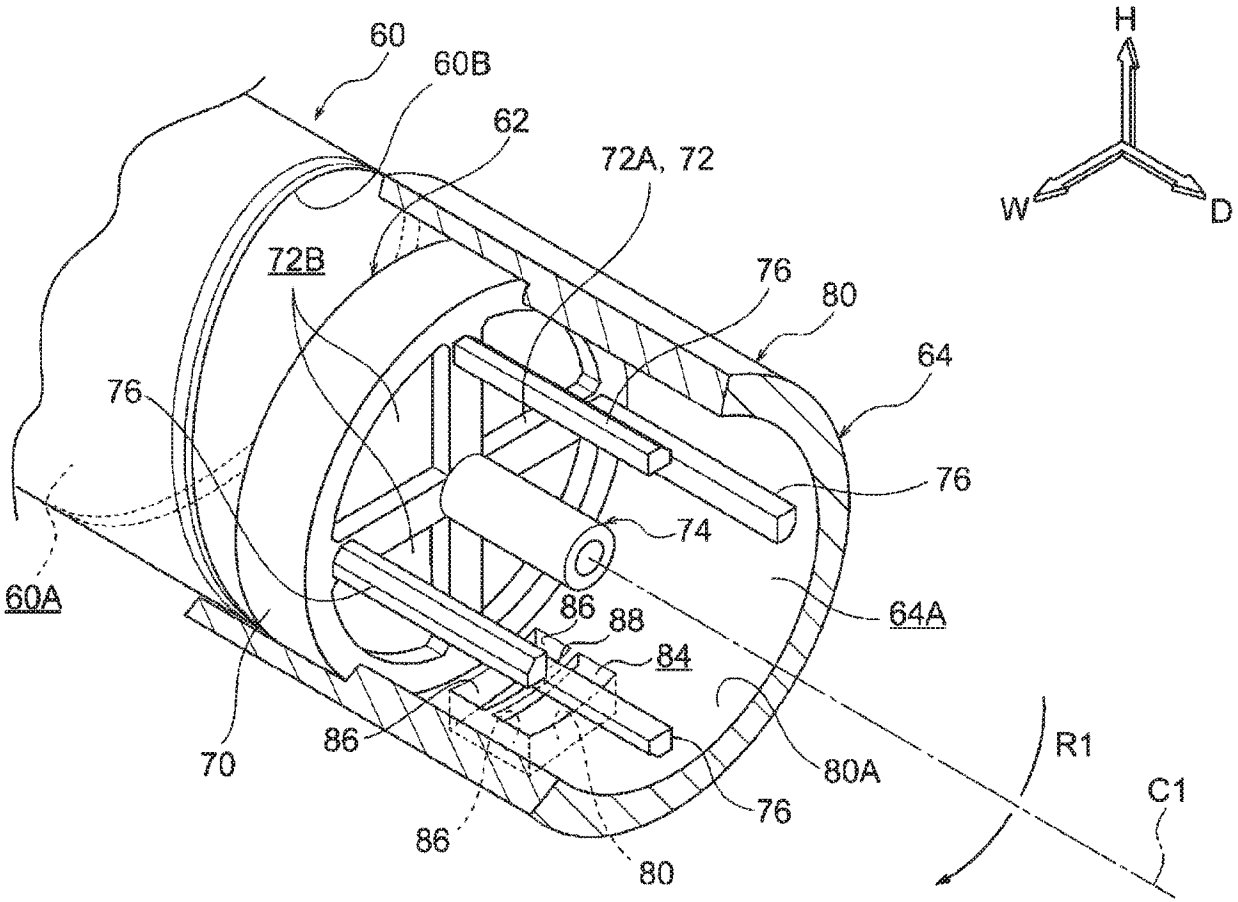
FIG. 1 is an enlarged perspective view illustrating a powder material storage container according to a first exemplary embodiment of the invention.

An example of a powder material storage container and an image forming apparatus according to the first exemplary embodiment of the invention will be described with reference to FIGS. 1 to 12. It is to be noted that in the drawings, an arrow H indicates a vertical direction that is an up and down direction of the apparatus, an arrow W indicates a horizontal direction that is a width direction of the apparatus, and an arrow D indicates a horizontal direction that is a depth direction of the apparatus.

(Entire Configuration of Image Forming Apparatus)

Figure 9:
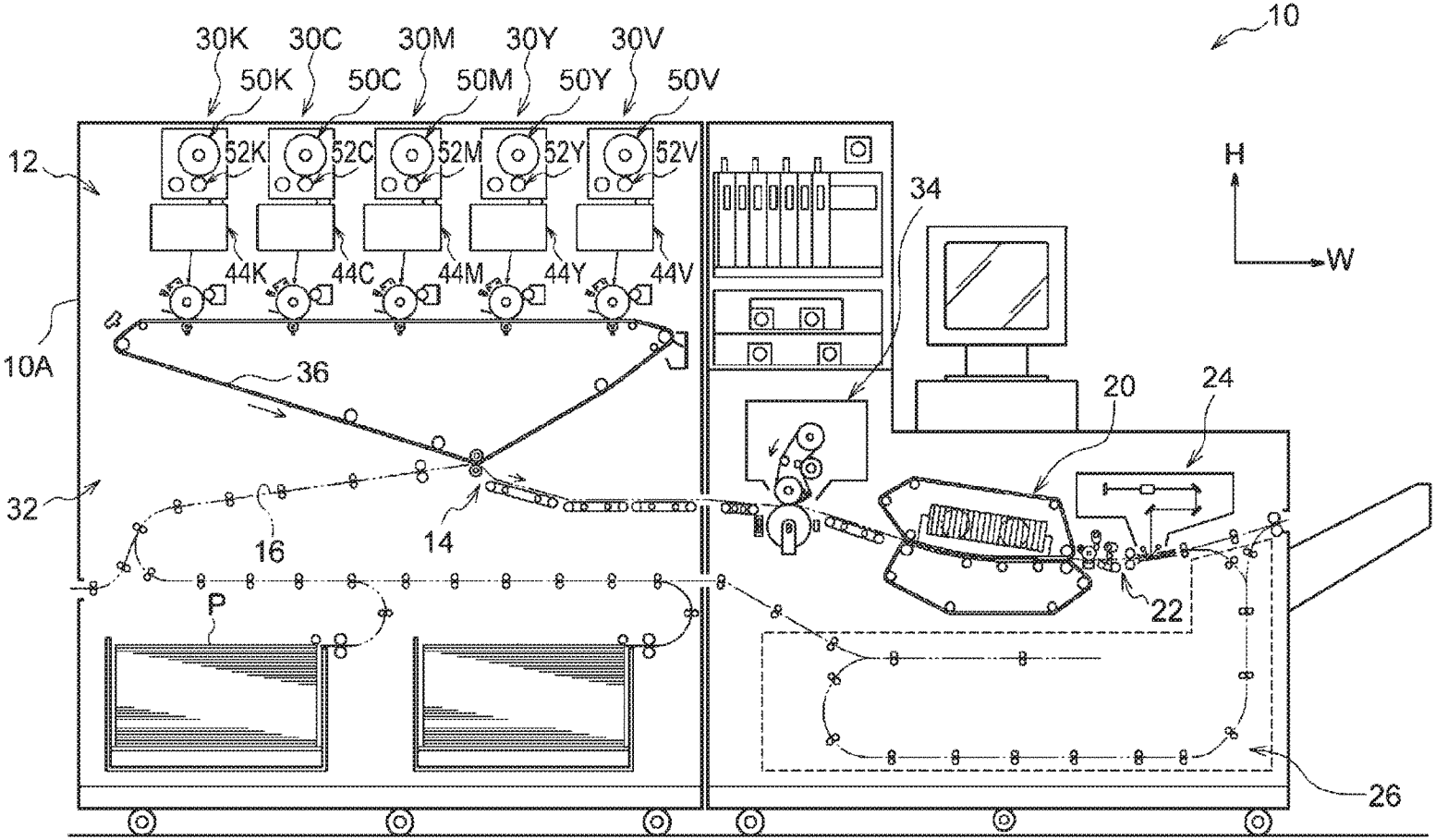
FIG. 9 is a configuration diagram illustrating the image forming apparatus according to the first exemplary embodiment of the invention.

As illustrated in FIG. 9, an image forming apparatus 10 includes an apparatus body 10A that is a housing, an image formation section 12 that forms an image by an electrophotographic system, and multiple transport members (symbol is omitted) that transport a sheet member P as an example of a recording medium along a transport path 16.

In addition, the image forming apparatus 10 includes a cooler 20 that cools the sheet member P having an image formed, a corrector 22 that corrects the curve of the sheet member P, and an image inspector 24 that inspects an image formed on the sheet member P.

Furthermore, the image forming apparatus 10 includes a reverse path 26 for reversing the sheet member P having an image formed on the front side, and transporting the sheet member P to the image formation section 12 again to form images on both sides of the sheet member P.

In the image forming apparatus 10 in the above-described configuration, an image (toner image) formed by the image formation section 12 is formed on the front side of the sheet member P which is transported along the transport path 16. Furthermore, the sheet member P having an image formed is passed through the cooler 20, the corrector 22, and the image inspector 24 on this order and is discharged to the outside of the apparatus.

When an image is formed on the back side of the sheet member P, the sheet member P having an image formed on the front side is transported along the reverse path 26, and an image is formed on the back side of the sheet member P by the image formation section 12 again.

(Image Formation Section)

The image formation section 12 includes multiple toner image formation sections 30 that form respective color toner images, and a transfer unit 32 that transfers the toner images formed by the toner image formation sections 30 to the sheet member P. Furthermore, each image formation section 12 includes a fixing device 34 that fixes an toner image transferred to the sheet member P by the transfer unit 32 on the sheet member P.

Multiple toner image formation sections 30 are provided so as to form respective toner images. In this exemplary embodiment, there are provided toner image formation sections 30 for the total of 5 colors: a special color (V), yellow (Y), magenta (M), cyan (C), and black (K). It is to be noted that in the following description, when it is unnecessary to distinguish between a transparent color (V), yellow (Y), magenta (M), cyan (C), and black (K), those labels for symbols, V, Y, M, C, and K are omitted.

Figure 8:
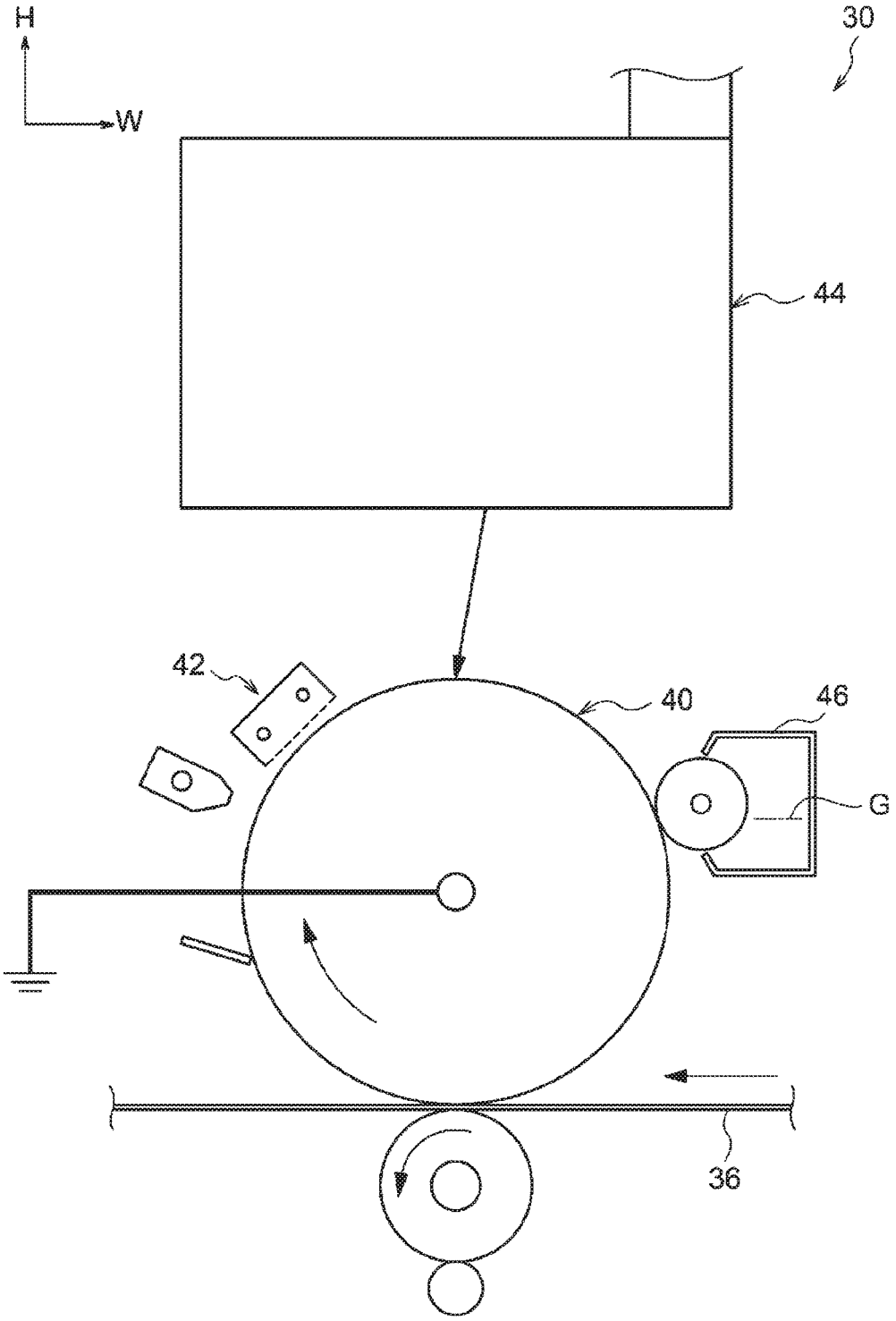
FIG. 8 is a configuration diagram illustrating a toner image formation section of an image forming apparatus according to the first exemplary embodiment of the invention.

The toner image formation sections 30 for the respective colors basically have the same configuration except for toner T to be used, and as illustrated in FIG. 8, includes a cylindrical image carrier 40, and a charging unit 42 that charges the image carrier 40. Furthermore, each toner image formation section 30 includes an exposure device 44 that radiates the charged image carrier 40 with exposure light to form an electrostatic latent image, and a developing device 46 that develops an electrostatic latent image as a toner image with a developer G including toner T.

The developing device 46 develops an electrostatic latent image formed in the outer circumferential surface of the image carrier 40, as a toner image with the developer G including toner T (an example of powder material) and a carrier CA, thereby forming a toner image in the outer circumferential surface of the image carrier 40. In addition, the image formation section 12 is provided with powder material storage containers 50 (see FIG. 9) for replenishing the developing device 46 with toner T.

As illustrated in FIG. 9, the powder material storage container 50 for each color is disposed in parallel to the width direction of the apparatus above the exposure device 44 for a corresponding color. The details of the powder material storage container 50 will be described later.

Furthermore, under each powder material storage container 50, there is disposed a reservoir tank 52 that receives toner T from the powder material storage container 50 and temporarily stores toner T, and that is connected to the developing device 46 (see FIG. 8) via a transport path (not illustrated).

Also, the image carrier 40 for each color is in contact with a transfer belt 36 that makes an orbiting motion. As illustrated in FIGS. 8 and 9, from the upstream side in the orbiting direction (see an arrow in FIGS. 8 and 9) of the transfer belt 36, the toner image formation sections 30 for the transparent color (V), yellow (Y), magenta (M), cyan (C), and black (K) are disposed in parallel to the horizontal direction in this order.

(Principal-Part Configuration)

Next, the powder material storage container 50 will be described.

Figure 2:
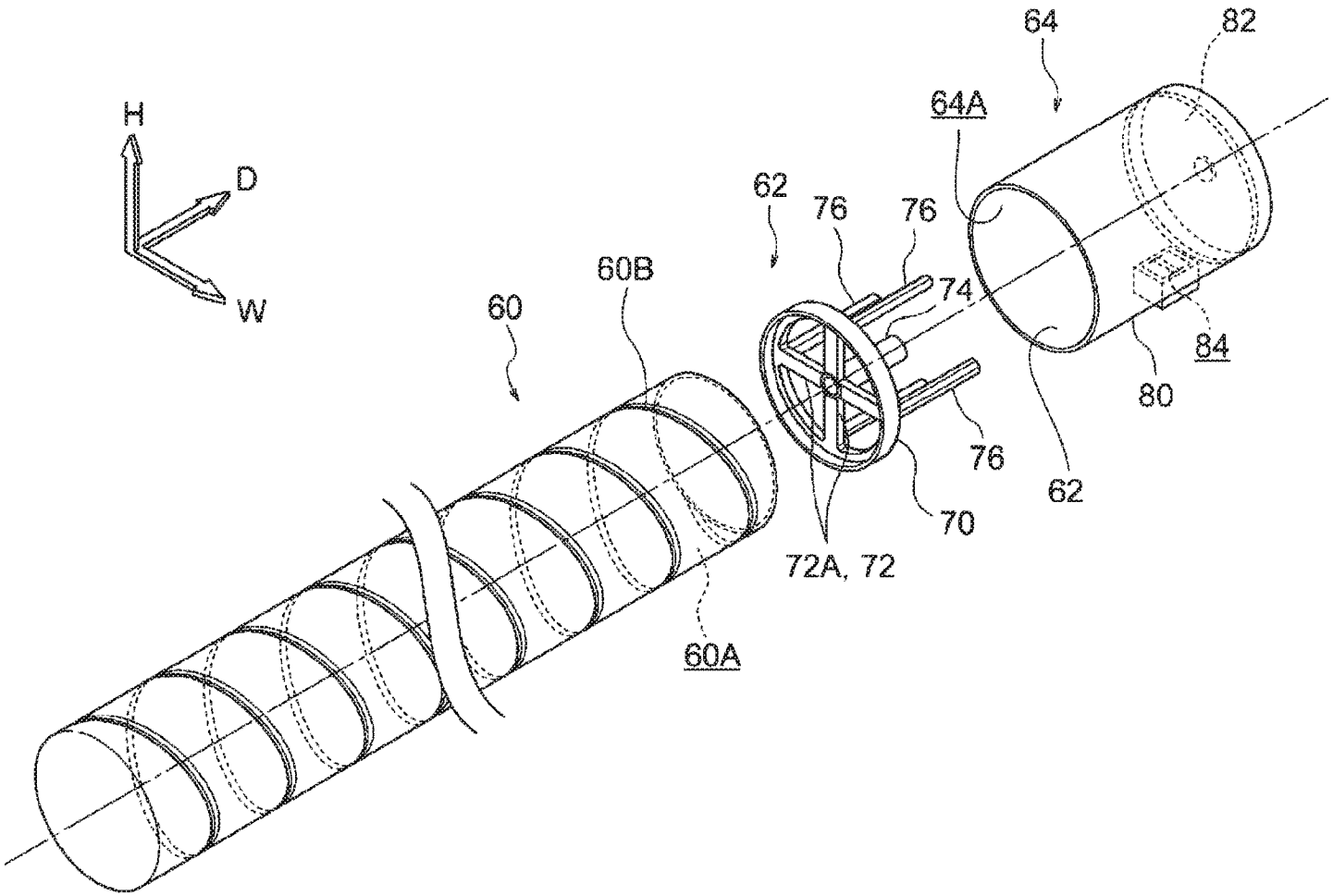
FIG. 2 is an exploded perspective view illustrating the powder material storage container according to the first exemplary embodiment of the invention.
Figure 3:
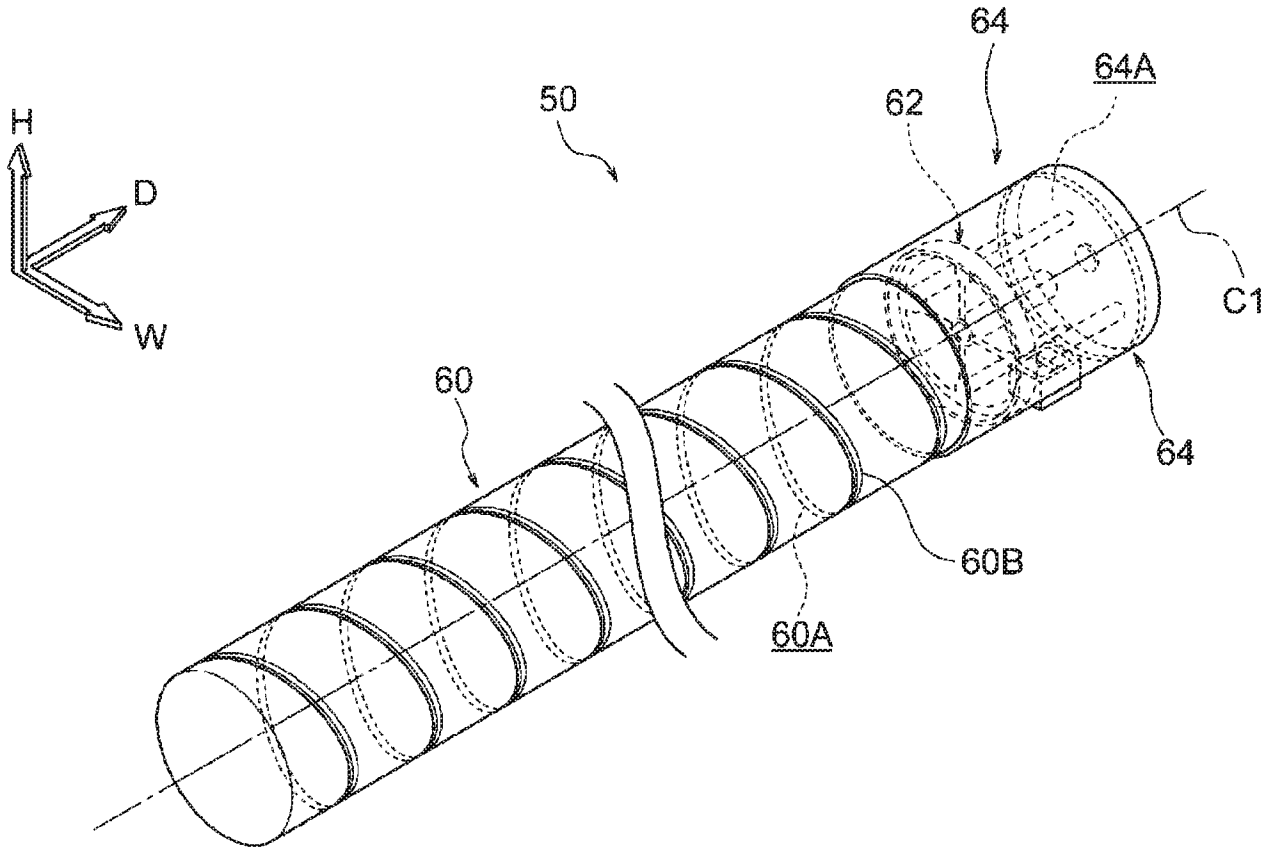
FIG. 3 is a perspective view illustrating the powder material storage container according to the first exemplary embodiment of the invention.

As illustrated in FIGS. 2 and 3, the powder material storage container 50 includes a body member 60, a fixed member 62 fixed to an end of the body member 60, and an end member 64 attached to the end of the body member 60.

[Body Member]

The body member 60 is a cylindrical shape extending in the apparatus depth direction. The near side (the left side in FIGS. 2 and 3) in the apparatus depth direction is closed, and the far side (the right side in FIGS. 2 and 3) in the apparatus depth direction is open. Inside the body member 60, a storage chamber 60A that stores toner T is formed. Furthermore, in the inner circumferential surface of the body member 60, a projection 60B, which extends spirally and projects inwardly of the storage chamber 60A, is formed. The projection 60B is an example of the transport member, and the apparatus depth direction is an example of the one direction.

In this exemplary embodiment, as an example, the length of the apparatus depth direction of the body member 60 is set to be 550 [mm], and the inner diameter is set to be 150 [mm]. In addition, the pitch of the projection 60B is set to be 20 [mm], and the projection height, by which the projection 60B projects inwardly of the storage chamber 60A, is set to be 5 [mm].

[Fixed Member]

As illustrated in FIG. 1, the fixed member 62 is fixed to the end of the body member 60 on the far side in the apparatus depth direction. The fixed member 62 is integrally formed, and has a cylinder section 70, a partition section 72, a transmission section 74, and rod sections 76. Each of the rod sections 76 is an example of the pillar member.

—Cylinder Section—

Figure 4:
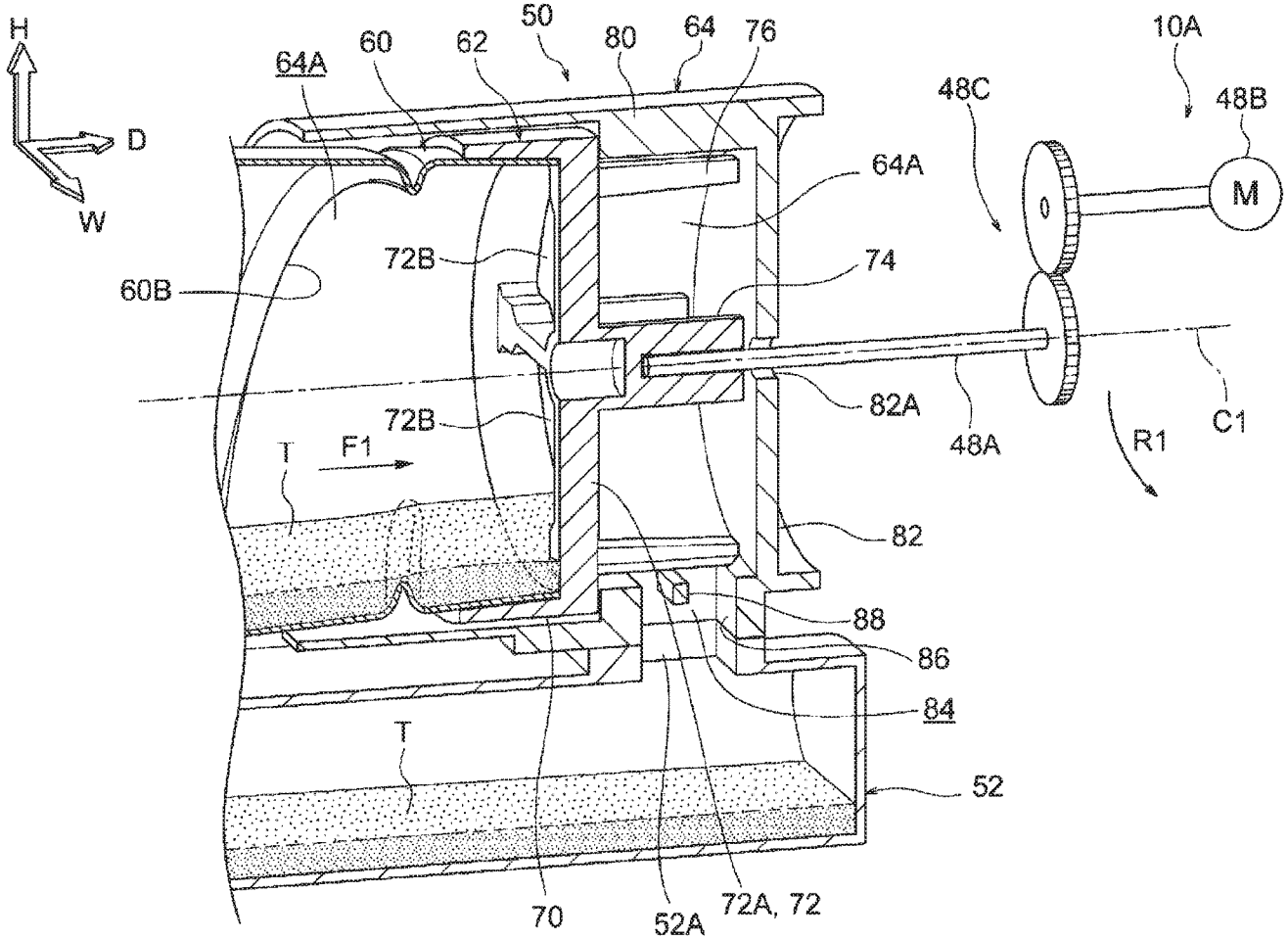
FIG. 4 is a sectional perspective view illustrating the powder material storage container according to the first exemplary embodiment of the invention.

The cylinder section 70 is cylindrical, and a portion of the body member 60 on the far side in the apparatus depth direction is inserted in the inside of the cylinder section 70 (see FIG. 4).

—Partition Section—

The partition section 72 is surrounded by the cylinder section 70 when viewed in the apparatus depth direction, and is designed to partition the body member 60 into the later-described passage chamber 64A formed inwardly of the end member 64 and the storage chamber 60A. The partition section 72 has a cross-shaped skeleton section 72A when viewed in the apparatus depth direction. The center of the cross-shaped skeleton section 72A is positioned on a center line C1 of the body member 60.

Also, the space surrounded by the cylinder section 70 and skeleton section 72A defines a movement port 72B, through which toner T is passed when toner T is moved from the storage chamber 60A to the passage chamber 64A. In this exemplary embodiment, the movement port 72B has a sector shape and four pieces of the movement port 72B are provided. The opening area of each movement port 72B is set to be greater than the opening area of the later-described discharge outlet 84.

—Transmission Section—

The transmission section 74 is disposed in the passage chamber 64A formed inwardly of the end member 64. The transmission section 74 is fixed at its base end to the center of the cross-shaped skeleton section 72A, and is a cylindrical shape extending to the far side in the apparatus depth direction on the center line C1 of the body member 60. In a state where the powder material storage container 50 is attached to the apparatus body 10A, as illustrated in FIG. 4, the leading end of a cylindrical rotational shaft 48A disposed in the apparatus body 10A is inserted in the transmission section 74.

A rotational force is transmitted to the rotational shaft 48A from a motor 48B via a gear group 48C. Transmission of the rotational force of the motor 48B to the transmission section 74 via the rotational shaft 48A causes the fixed member 62 and the body member 60 to rotate in an arrow R1 direction (the clockwise direction when viewed from the far side of the apparatus) around the center line C1 of the body member 60.

—Rod Section—

As illustrated in FIG. 1, the rod section 76 is disposed in the passage chamber 64A formed inwardly of the end member 64. Four pieces of the rod section 76 are provided, and disposed at spaces in a circumferential direction of the cylinder section 70. Each rod section 76 is fixed at its base end to the leading end of the cross-shaped skeleton section 72A, and extends to the far side in the apparatus depth direction.

Figure 6A:
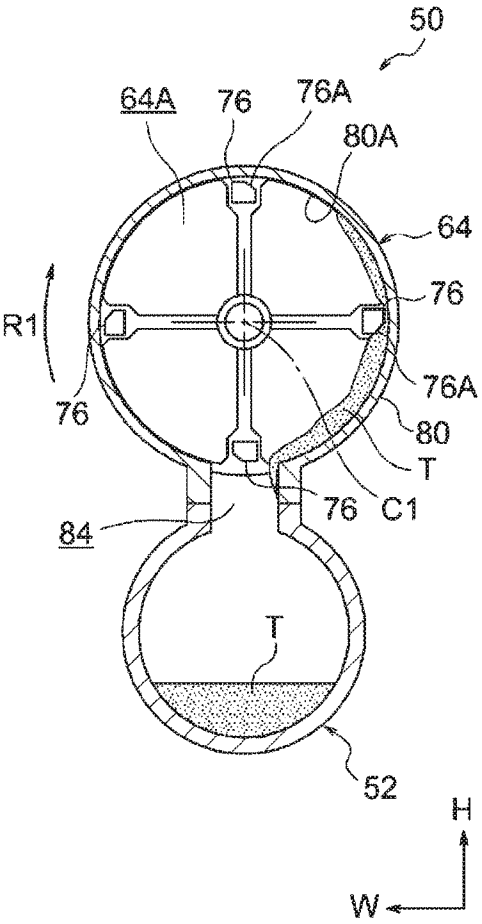
FIGS. 6A to 6C provide a process chart illustrating a process in which toner is discharged to the outside using the powder material storage container according to the first exemplary embodiment of the invention.

Each rod section 76 includes an inclined surface 76A that is inclined so that the downstream side is separated from the later-described inner circumferential surface 80A of the end member 64 with respect to the upstream side in the rotation direction (arrow R1 direction in FIG. 6A) when viewed in the apparatus depth direction as illustrated in FIG. 6A.

Figure 6B:
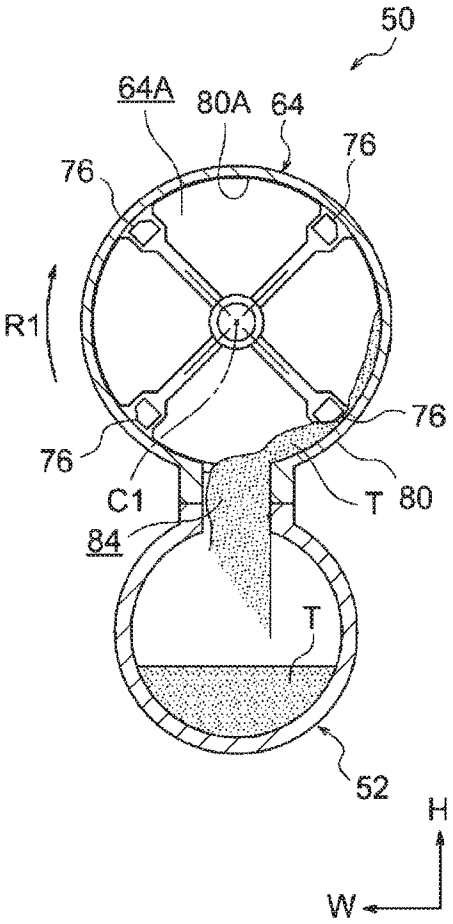
Figure 6C:
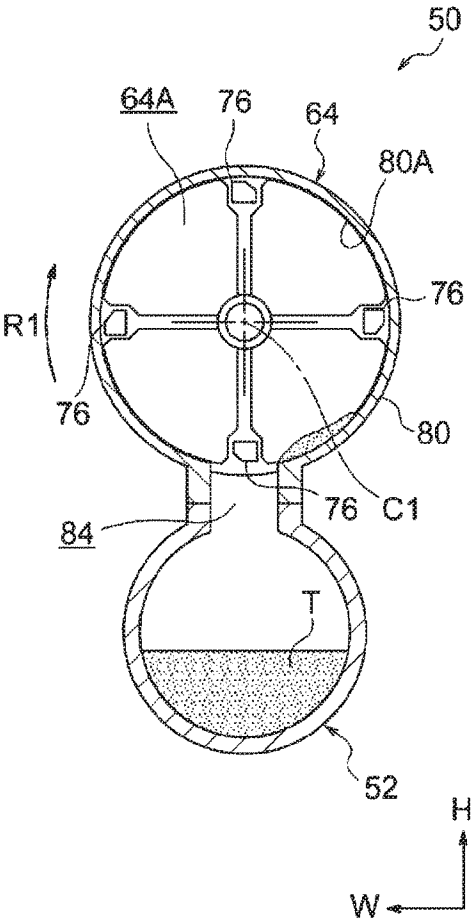

In this configuration, rotation of the fixed member 62 around the center line C1 of the body member 60 causes each rod section 76 included in the fixed member 62 to rotate around the center line C1 of the body member 60. Specifically, as illustrated in FIGS. 6A, 6B and 6C, each rod section 76 is rotated along the inner circumferential surface 80A of the end member 64 with clearance between the rod section 76 and the inner circumferential surface 80A.

[End Member]

As illustrated in FIGS. 2 and 3, the end member 64 is disposed on the far side in the apparatus depth direction of the body member 60, and has a cylindrical base 80 that extends in the apparatus depth direction, and a base plate 82 that closes the far side of the base 80 in the apparatus depth direction. In a state where part of the body member 60 is covered from the outside by a portion of the near side of the base 80 in the apparatus depth direction, and the end member 64 is attached to the body member 60, the end member 64 is movable relative to the fixed member 62 and the body member 60 in the circumferential direction of the body member 60. In other words, the fixed member 62 and the body member 60 are movable relative to the end member 64 in the circumferential direction of the body member 60.

As illustrated in FIG. 1, a discharge outlet 84 for discharging toner T to the outside is formed at a portion on the lower side of the inner circumferential surface 80A of the base 80. The discharge outlet 84 is rectangular when viewed from above, and is surrounded by four wall surfaces 86. In this exemplary embodiment, the opening area (the area surrounded by the four wall surfaces 86) of the discharge outlet 84 is set to be 400 [$mm^2$]. The inner circumferential surface 80A is an example of the wall surface.

The inside of the end member 64 defines the passage chamber 64A in which toner T is passed from the storage chamber 60A through the movement ports 72B, and is further discharged through the discharge outlet 84 to the outside of the powder material storage container 50.

Figures 5A, 5B, 5C:
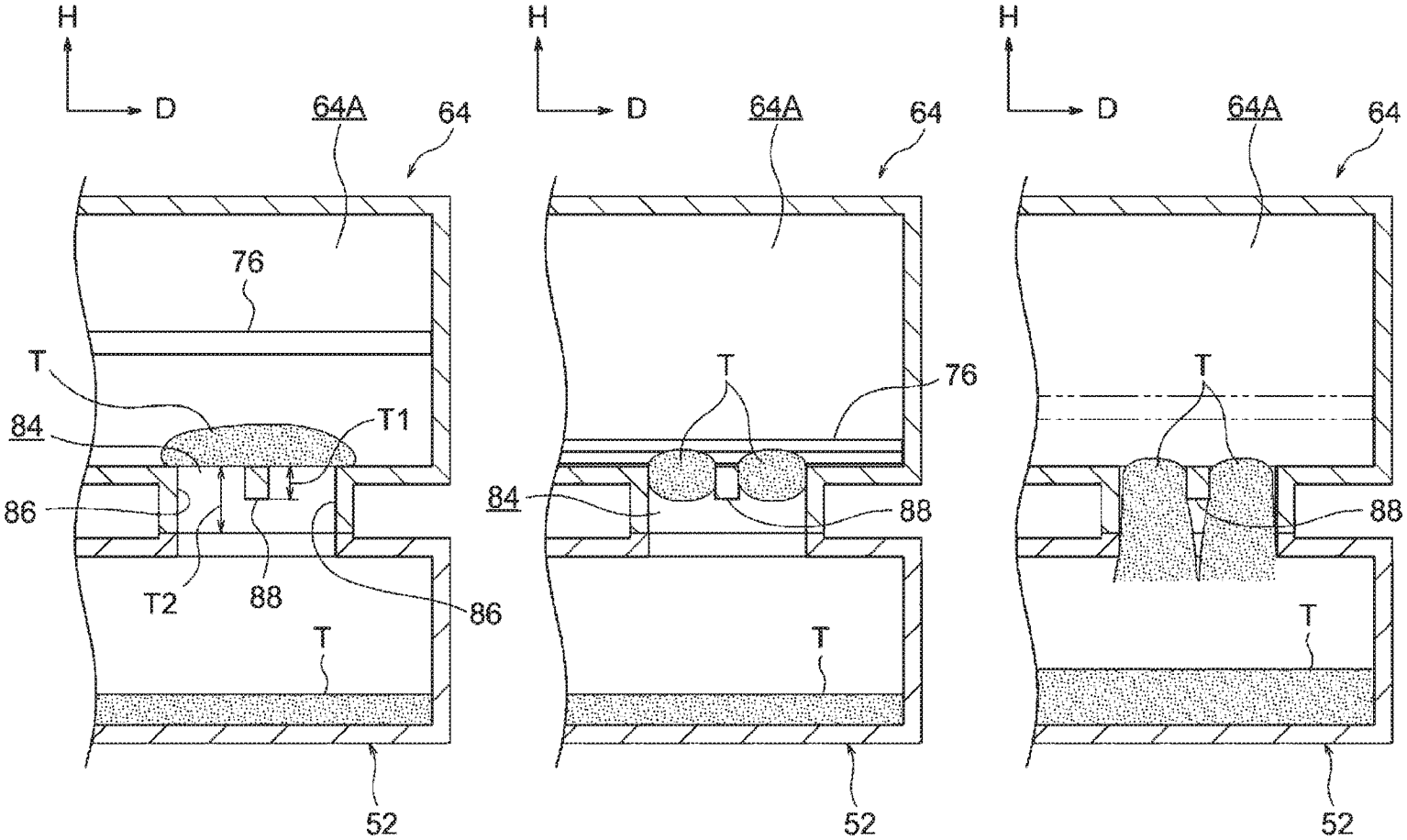
FIGS. 5A to 5C provide a process chart illustrating a process in which toner is discharged to the outside using the powder material storage container according to the first exemplary embodiment of the invention.

Also, the end member 64 includes a beam member 88 that is laid across a central portion of the discharge outlet 84 in the apparatus depth direction. The beam member 88 extends in the rotation direction (the R1 direction in FIG. 1) of the rod section 76, and as illustrated in FIG. 5A, the vertical length (T1 in FIG. 5A) of the beam member 88 is set to be shorter than the vertical length (T2 in FIG. 5A) of each wall surface 86 of the discharge outlet 84. Furthermore, the upper surface of the beam member 88 is flush with the passage chamber 64A. In short, the upper surface of the beam member 88 is circular when viewed in the apparatus depth direction.

As illustrated in FIG. 4, in the base plate 82 of the end member 64, a through hole 82A, through which the rotational shaft 48A passes through, is formed. Then, a seal member (not illustrated), which protects against leakage of toner T to the outside through between the rotational shaft 48A and the through hole 82A, is attached to the rotational shaft 48A.

(Operation)

Next, the operation of the powder material storage container 50 will be described by comparing it with a powder material storage container 350 according to the comparative example. First, the configuration of the powder material storage container 350 will be described. It is to be noted that part of the configuration of the powder material storage container 350 different from the configuration of the powder material storage container 50 will be mainly described.

Figure 10:
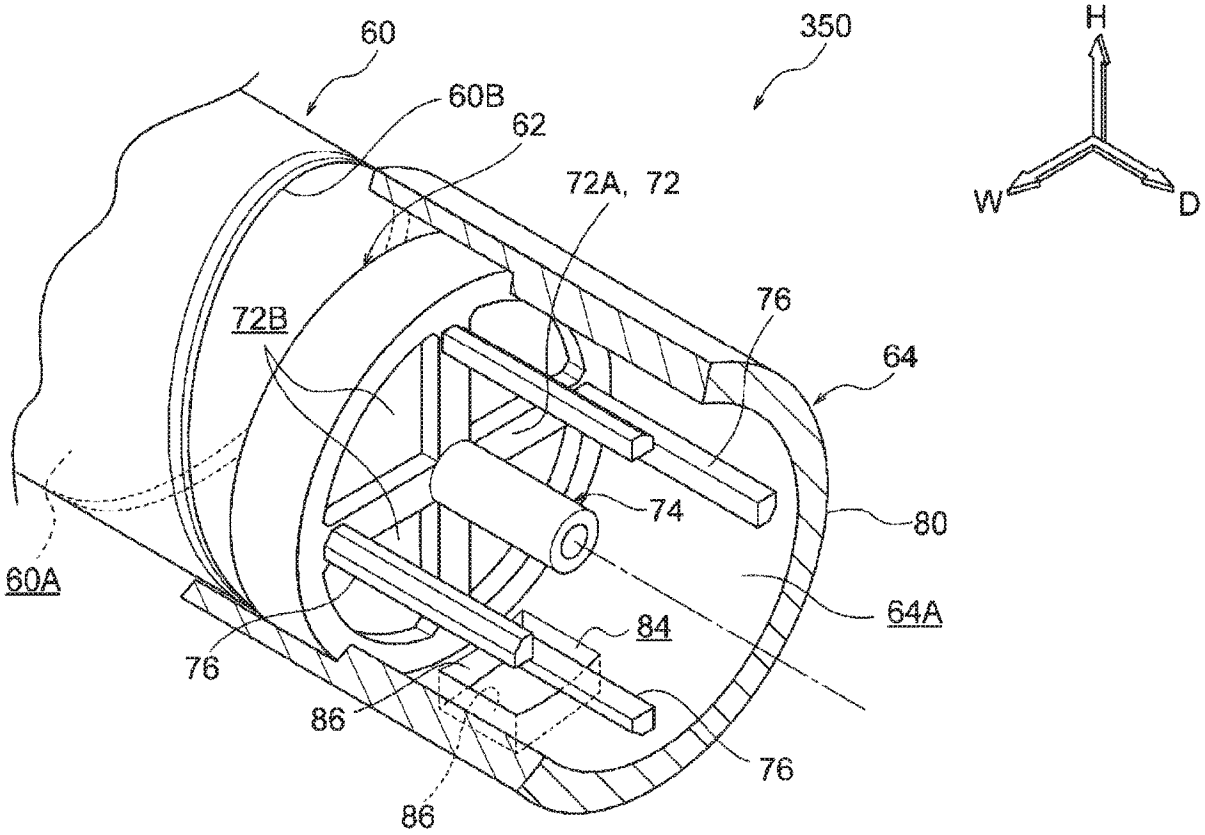
FIG. 10 is an enlarged perspective view illustrating a powder material storage container according to a comparative example to the first exemplary embodiment of the invention.

As illustrated in FIG. 10, in the end member 64 of the powder material storage container 350, a beam member 88 laid across the discharge outlet 84 is not formed.

Hereinafter, the operation of the powder material storage container 50 will be described.

As illustrated in FIG. 4, toner T is stored in the body member 60 of the powder material storage container 50. In a state where the powder material storage container 50 is attached to the apparatus body 10A, the leading end of the rotational shaft 48A is inserted in the transmission section 74 of the fixed member 62, and the discharge outlet 84 is guided to an opening 52A of the reservoir tank 52 disposed under the powder material storage container 50.

When toner T stored in the reservoir tank 52 is reduced and becomes lower than a predetermined amount, a controller (not illustrated) drives the motor 48B. Thus, a rotational force is transmitted from the motor 48B to the rotational shaft 48A via the gear group 48C. Transmission of the rotational force of the motor 48B to the transmission section 74 via the rotational shaft 48A causes the fixed member 62 and the body member 60 to rotate in the arrow R1 direction around the center line C1 of the body member 60. It is to be noted that the end member 64 is not rotated.

Rotation of the body member 60 causes the inwardly projecting spiral projection 60B to rotate. Here, toner T stored in the body member 60 slides on the inner circumferential surface of the body member 60 due to the gravity. Thus, the rotating spiral projection 60 pushes toner T to the far side in the apparatus depth direction, and moves toner T to the far side in the apparatus depth direction (see F1 arrow in FIG. 4).

The toner T pushed by the rotating spiral projection 60 is moved to the passage chamber 64A through the movement port 72B of the partition section 72. Part of toner T moved to the passage chamber 64A is discharged to the reservoir tank 52 as it is through the discharge outlet 84. Another part of toner T stays as a chunk of toner at an upper portion of the discharge outlet 84. Still another part of toner T adheres to the inner circumferential surface 80A of the base 80.

When toner T stays as a chunk of toner at an upper portion of the discharge outlet 84, as illustrated in FIGS. 5A and 5B, the rotating rod section 76 pushes a chunk of toner T to the discharge outlet 84 by the inclined surface 76A (see FIG. 6A). Furthermore, the beam member 88 divides and breaks down toner T pushed to the discharge outlet 84. Consequently, as illustrated in FIG. 5C, the broken down toner T is discharged to the reservoir tank 52 through the discharge outlet 84.

It is to be noted that when the beam member extends in the axial direction of the rotating rod section 76, a chunk of toner T is once pushed to the beam member extending in the axial direction by the rotating rod section 76, and thus toner T may not be divided.

When toner T adheres to the inner circumferential surface 80A of the base 80, as illustrated in FIGS. 6A and 6B, the rod sections 76 rotating in the circumferential direction of the passage chamber 64A push and move toner T adhering to the inner circumferential surface 80A to the discharge outlet 84. Consequently, as illustrated in FIGS. 6A and 6B, toner T moved to the discharge outlet 84 is discharged to the reservoir tank 52 through the discharge outlet 84.

Figure 11B:
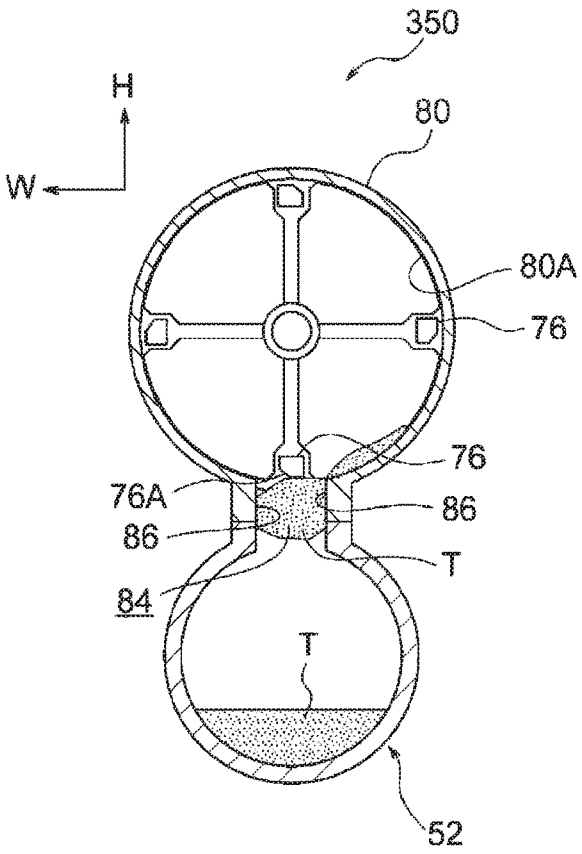
FIGS. 11A and 11B provide a process chart illustrating a process in which toner is discharged to the outside using the powder material storage container according to the comparative example to the first exemplary embodiment of the invention.
Figure 11A:
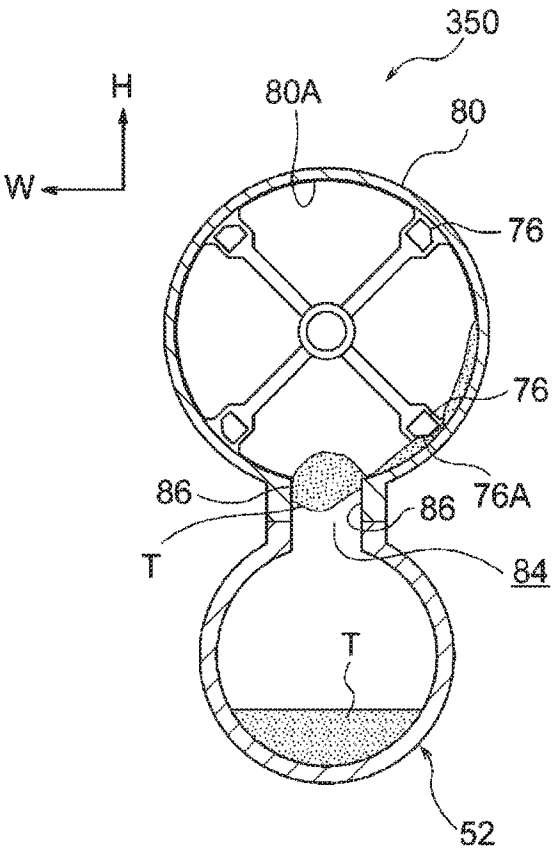

When the powder material storage container 350 is used and toner T still stays as a chunk of toner at an upper portion of the discharge outlet 84, as illustrated in FIGS. 11A and 11B, toner T pushed to the discharge outlet 84 by the rotating rod section 76 is caught by the wall surfaces 86 of the discharge outlet 84, which is clogged with the toner T.

Here, the evaluation made on each of the powder material storage container 50 and the powder material storage container 350 will be described.

1. Valuation Method and Evaluation Items

Each of the powder material storage containers 50, 350 with toner T internally stored is attached to the apparatus body 10A, and the fixed member 62 and the body member 60 are rotated at 20 [rpm]. The amount (mass) of discharge of toner T discharged through the discharge outlet 84 is evaluated. It is to be noted that for the amount of discharge of toner T, a mass meter is disposed below the discharge outlet 84 and the amount of discharge is measured using the mass meter.

Before the powder material storage containers 50, 350 are attached to the apparatus body 10A, the powder material storage containers 50, 350, disposed in a vertically movable manner, are moved up and down (vibrated) for 400 times so that a chunk of toner T is broken down. Furthermore, the powder material storage containers 50, 350 are left for 48 hours in the environment at the room temperature of 45 [° C.] and the relative humidity of 95[%], each of the powder material storage containers 50, 350 is attached to the apparatus body 10A.

As toner T, the color toner for Docu Center Color400, manufactured by Fuji Xerox is used.

2. Evaluation Result

Figure 7:
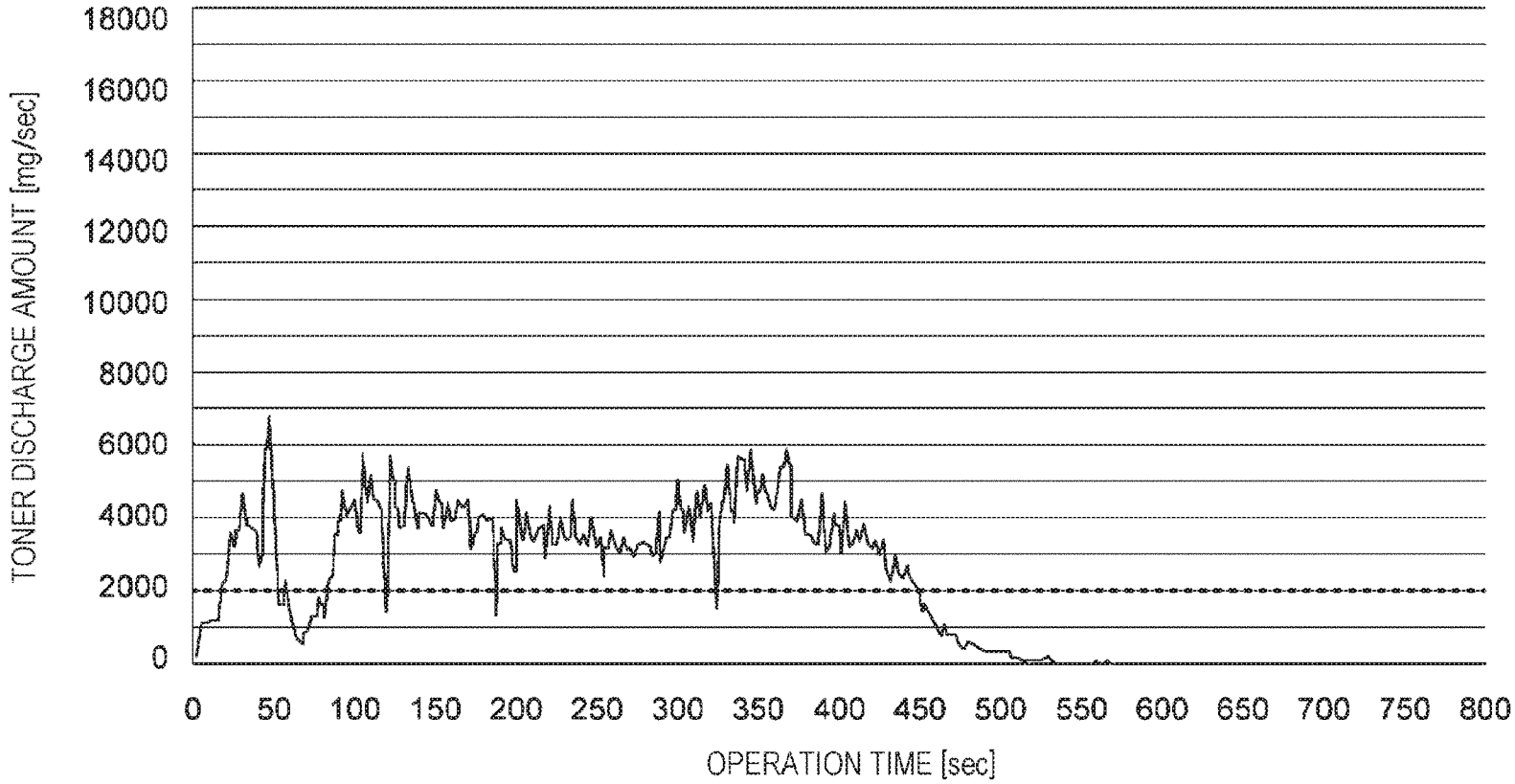
FIG. 7 is a graph illustrating an evaluation result of evaluation of the powder material storage container according to the first exemplary embodiment of the invention.
Figure 12:
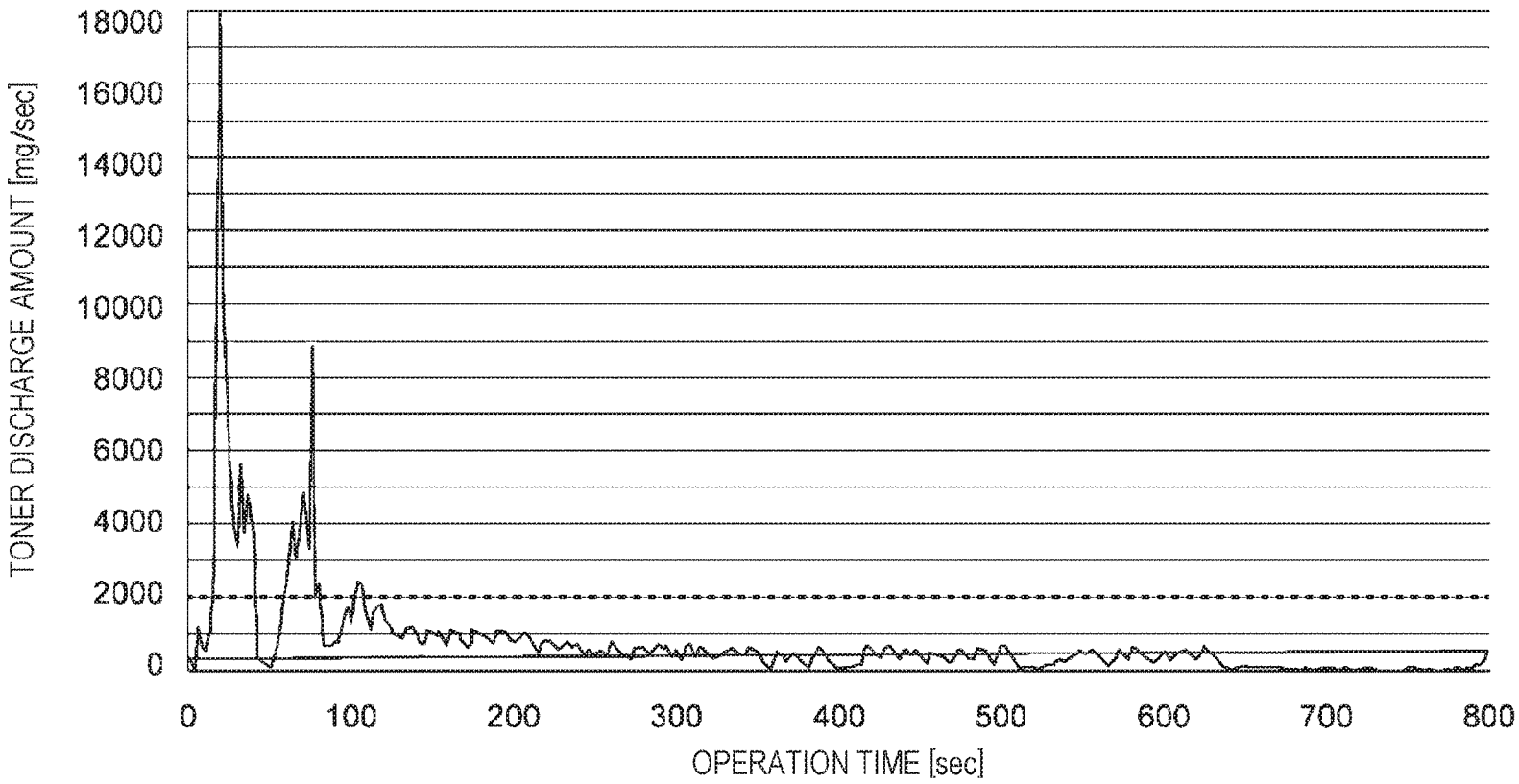
FIG. 12 is a graph illustrating an evaluation result of evaluation of the powder material storage container according to the comparative example to the first exemplary embodiment of the invention.

In FIG. 7, an evaluation result of the powder material storage container 50 is indicated by the graph, and in FIG. 12, an evaluation result of the powder material storage container 350 is indicated by the graph.

The vertical axis of each graph indicates the amount of discharge of toner T per unit time [mg/sec], and the horizontal axis indicates the operation time [sec] during which the fixed member 62 and the body member 60 are rotated. Also, for the powder material storage containers 50, 350, a target lower limit value of the amount of discharge of toner T per unit time is 2000 [mg/sec] or greater.

For the powder material storage container 50, as illustrated by the graph of FIG. 7, at an initial stage when the fixed member 62 and the body member 60 are started to rotate, the amount of discharge may fall below the target lower limit value of the amount of discharge. However, after the initial stage of the powder material storage container 50, the amount of discharge exceeds the target lower limit value of the amount of discharge, and most of the toner T stored in the powder material storage container 50 is discharged through the discharge outlet 84.

On the other hand, for the powder material storage container 350, as illustrated by the graph of FIG. 12, the amount of discharge has been mostly lower than the target lower limit value of the amount of discharge since the initial stage when the fixed member 62 and the body member 60 are started to rotate, and the toner T stored in the powder material storage container 350 has remained in the powder material storage container 350. This is because the discharge outlet 84 is clogged with the toner T as described above.

(Summary)

As described above, for the powder material storage container 50, the beam member 88 laid across the discharge outlet 84 is formed. For this reason, the risk of clogging of the discharge outlet 84 by toner T is reduced, as compared with the powder material storage container 350 in which a beam member 88 extending from the upstream side to the downstream side of the rotation direction of the rod sections 76 is not formed.

Also, the beam member 88 laid across the discharge outlet 84 extend in the rotation direction of the rod sections 76. For this reason, the toner T pushed on the discharge outlet 84 is effectively divided by the rotating rod sections 76, and the risk of clogging of the discharge outlet 84 by toner T is reduced, for instance, as compared with the case where the beam member extends in a direction inclined with respect to the rotation direction of the rod sections 76.

Also, the vertical length of the beam member 88 is set to be shorter than the vertical length of the wall surfaces 86 of the discharge outlet 84, and the upper surface of the beam member 88 is flush with the passage chamber 64A. Thus, divided toner T is less caught between the wall surfaces 86 and the beam member 88, and the risk of clogging of the discharge outlet 84 by toner T is reduced, as compared with the case where the vertical length of the beam member is almost the same as the vertical length of the wall surface 86, and the upper surface of the beam member is separated away from the passage chamber 64A.

Also, providing the powder material storage container 50 in the image forming apparatus 10 causes inconsistencies in density of an output image to decrease.

Second Exemplary Embodiment

Next, an example of a powder material storage container, and an image forming apparatus according to a second exemplary embodiment of the invention will be described with reference to FIGS. 13 to 16. It is to be noted that the same member as that of the first exemplary embodiment is labeled with the same symbol and a description is omitted, and points different from the first exemplary embodiment will be mainly described.

Figure 13:
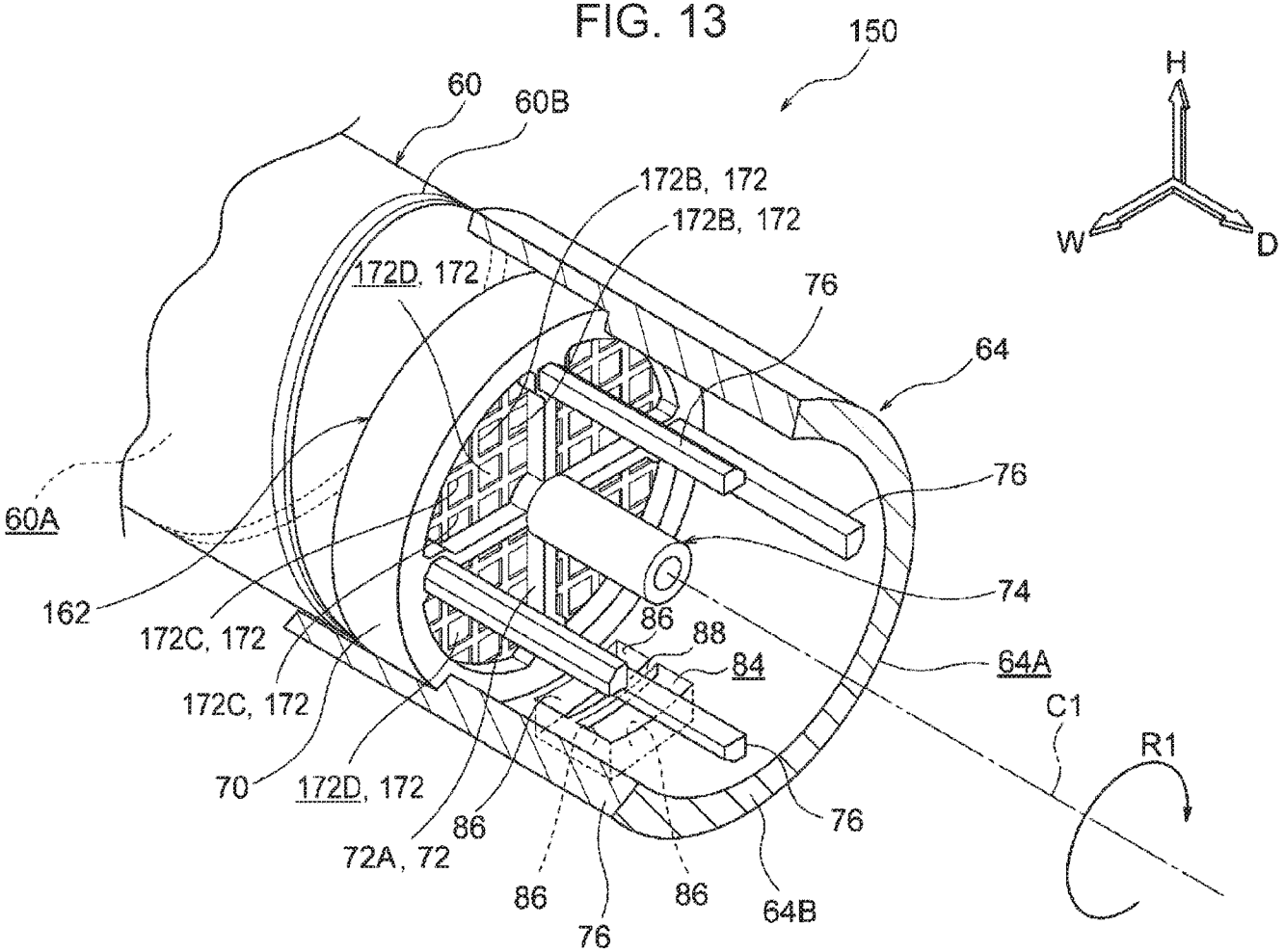
FIG. 13 is an enlarged perspective view illustrating a powder material storage container according to a second exemplary embodiment of the invention.
Figure 14:
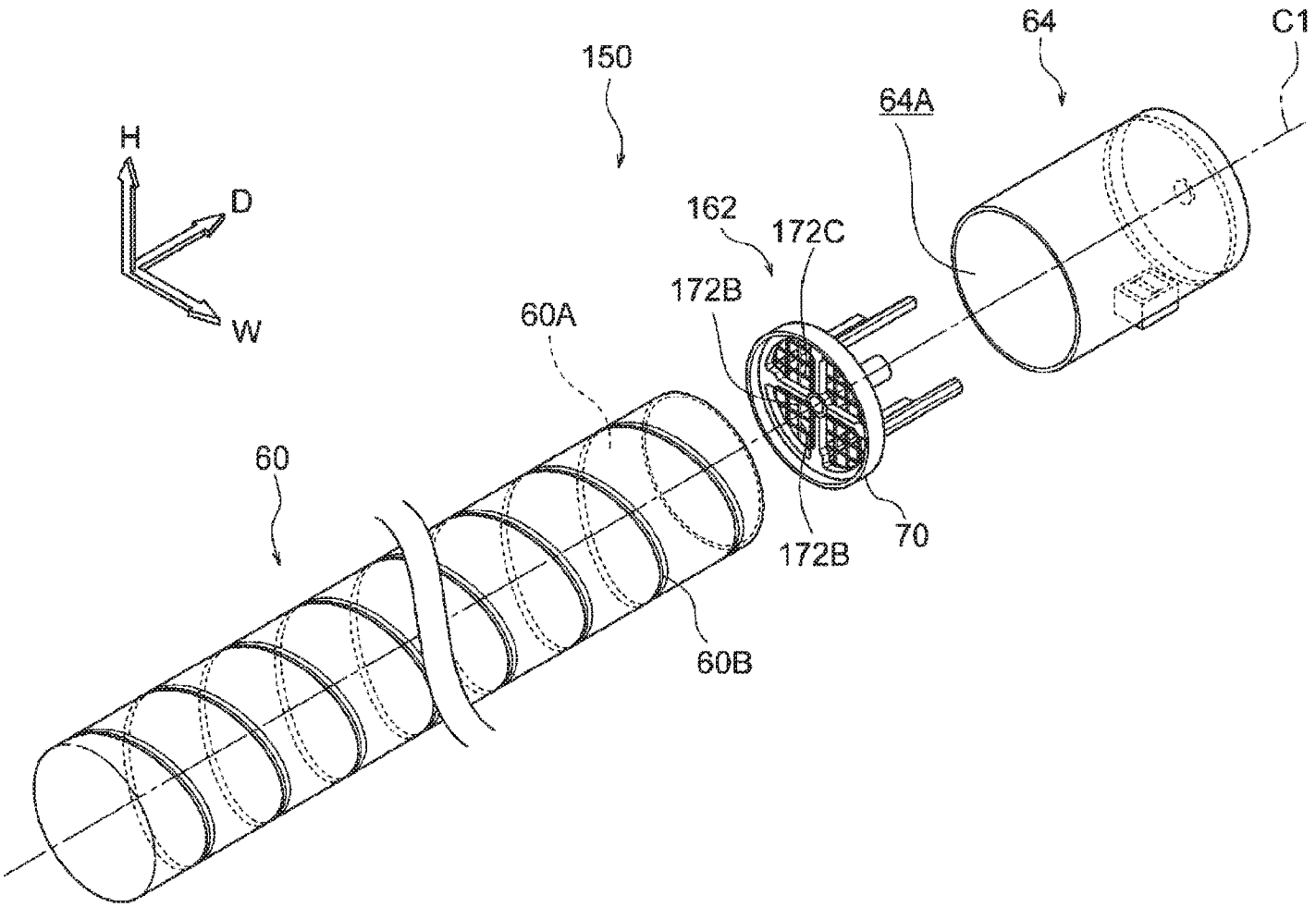
FIG. 14 is an exploded perspective view illustrating the powder material storage container according to the second exemplary embodiment of the invention.

As illustrated in FIGS. 13 and 14, a partition section 172 of a fixed member 162 of the powder material storage container 150 according to the second exemplary embodiment has a cross-shaped skeleton section 72A, multiple vertical rails 172B, and multiple horizontal rails 172C.

Figure 15A:
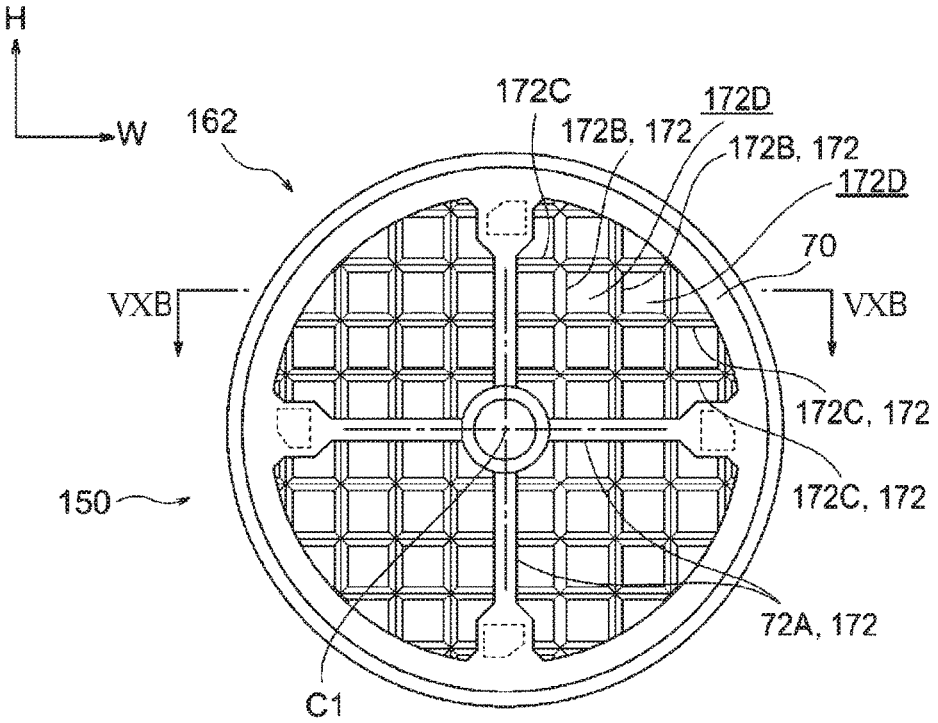
FIGS. 15A and 15B are respectively a front view and a sectional view illustrating a partition section of the powder material storage container according to the second exemplary embodiment of the invention.
Figure 15B:
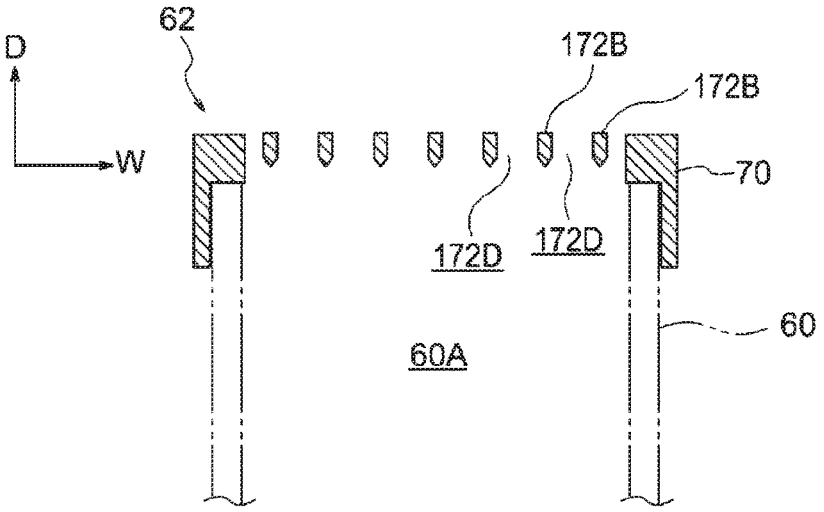

As illustrated in FIG. 15A, the vertical rails 172B, and the horizontal rails 172C are surrounded by the cylinder section 70 and the skeleton section 72A when viewed in the apparatus depth direction. In a state where the cross-shaped skeleton section 72A is disposed to extend in the apparatus width direction and the apparatus vertical direction, the vertical rails 172B extend in the apparatus vertical direction, and are disposed with predetermined spaces in the apparatus width direction. Also, the horizontal rails 172C extend in the apparatus width direction, and are disposed with predetermined spaces in the apparatus vertical direction. Furthermore, as illustrated in FIG. 15B, the vertical rails 172B are tapered toward the body member 60. Similarly to the vertical rails 172B, the horizontal rails 172C are tapered toward the body member 60.

Also, the spaces surrounded by the vertical rails 172B and the horizontal rails 172C each define a through hole 172D, through which toner T is passed when toner T is moved from the storage chamber 60A to the passage chamber 64A. In this exemplary embodiment, each through hole 172D is set to be rectangular, and the opening area of the through hole 172D is set to be equal to or smaller than the opening area of the discharge outlet 84.

With this configuration, when a chunk of toner T is moved from the storage chamber 60A to the passage chamber 64A, passing of the chunk of toner T through the through hole 172D causes the chunk of toner T to be broken down.

Next, in order to verify the effect of the formation of the through hole 172D, evaluation of the specification, in which the beam member 88 is not formed in the discharge outlet 84, and the vertical rails 172B and the horizontal rails 172C are flat toward the body member 60 in the powder material storage container 150, will be described. The valuation method and evaluation items are the same as those in the first exemplary embodiment.

Figure 16:
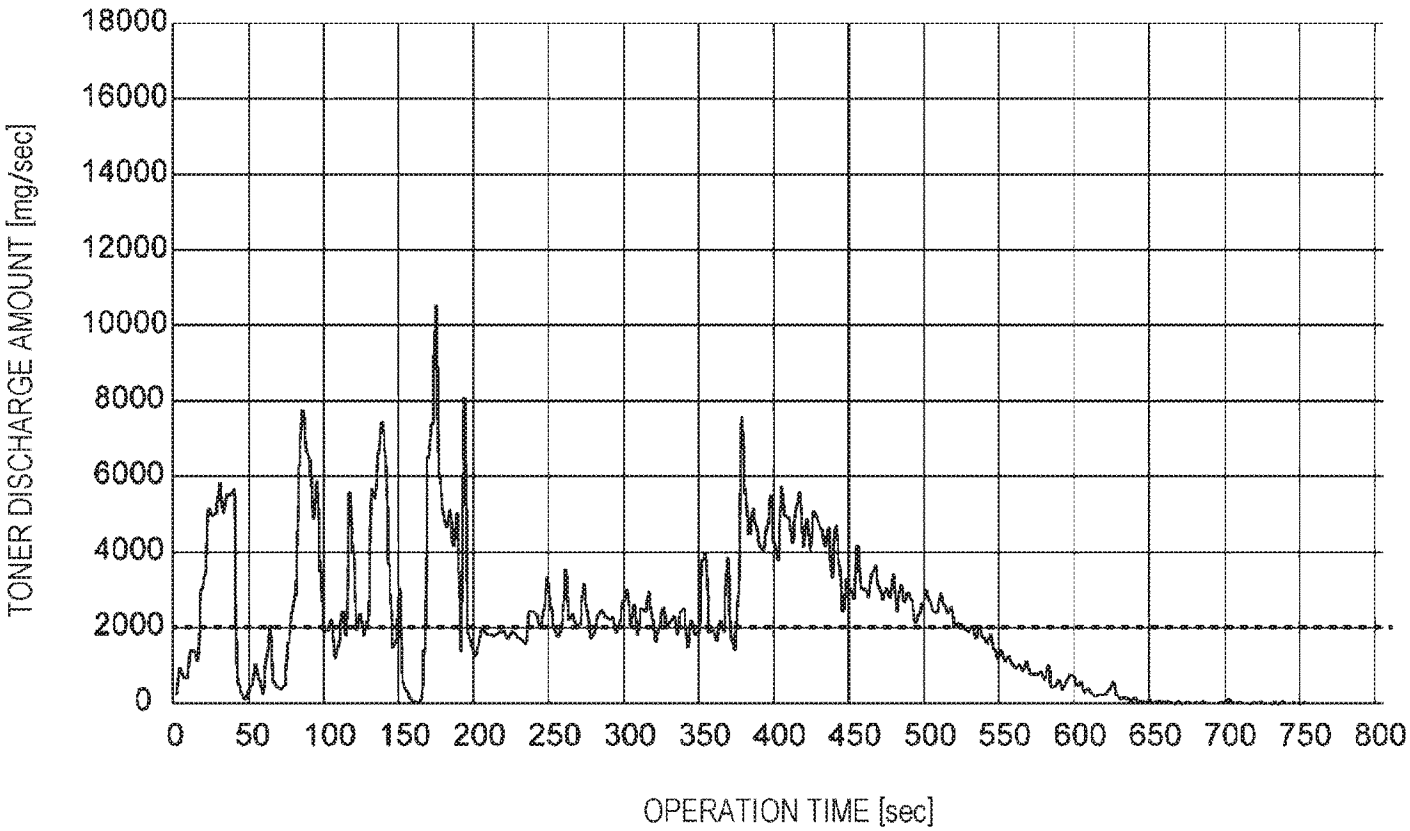
FIG. 16 is a graph illustrating an evaluation result of evaluation of a partially modified specification of the powder material storage container according to the second exemplary embodiment of the invention.

In FIG. 16, an evaluation result of the specification, in which the beam member 88 is not formed in the discharge outlet 84, and the vertical rails 172B and the horizontal rails 172C are flat toward the body member 60, is indicated by the graph.

In this specification, as illustrated in the graph of FIG. 16, at an initial stage when the fixed member 62 and the body member 60 are started to rotate, the amount of discharge may fall below the target lower limit value of the amount of discharge. However, after the initial stage in the specification, the amount of discharge exceeds the target lower limit value of the amount of discharge, and most of the toner T stored in the powder material storage container is discharged through the discharge outlet 84. This is because when a chunk of toner T is passed through the through holes 172D, the chunk of toner T is broken down.

(Summary)

As described above, in the powder material storage container 150, the through holes 172D, which cause a chunk of toner T passing therethrough to be broken down, are formed. Therefore, the risk of clogging of the discharge outlet 84 by toner T is reduced, as compared with the case where the through hole is larger than a chunk of toner T.

Also, the opening area of each through hole 172D is equal to or smaller than the opening area of the discharge outlet 84. For this reason, a chunk of toner T is broken down to a size discharged through the discharge outlet 84, and the risk of clogging of the discharge outlet 84 by toner T is reduced, as compared with the case where the opening area of the through hole 172D is greater than the opening area of the discharge outlet 84.

Also, the vertical rails 172B and the horizontal rails 172C are tapered toward the body member 60. For this reason, a chunk of toner T comes into contact with the vertical rails 172B and the horizontal rails 172C and is effectively broken down, and the risk of clogging of the discharge outlet 84 by toner T is reduced, as compared with the case where the vertical rails 172B and the horizontal rails 172C are flat toward the body member 60.

Other operations are the same as those in the first exemplary embodiment.

Although specific exemplary embodiments of the invention have been described in detail, the invention is not limited to those exemplary embodiments. It is apparent to those skilled in the art that various other exemplary embodiments can be implemented within a scope of the invention. For instance, in the first and second exemplary embodiments, the beam member 88 laid across the discharge outlet 84 extend in the rotation direction of the rod sections 76. However, the beam member may extend from the upstream side to the downstream side in the rotation direction of the rod sections 76. For instance, the beam member may extend in a direction inclined with respect to the rotation direction of the rod sections 76. However, in this case, an operation achieved by the extension of the beam member 88 to the rotation direction of the rod sections 76 does not occur.

In the first and second exemplary embodiments, the vertical length of the beam member 88 is set to be shorter than the vertical length of the wall surfaces 86 of the discharge outlet 84, and the upper surface of the beam member 88 is flush with the passage chamber 64A. However, the vertical length of the beam member 88 may be equal to or longer than the vertical length of the wall surfaces 86, and the upper surface of the beam member 88 may be separated away from the passage chamber 64A. However, in this case, an operation achieved by the vertical length of the beam member 88 being shorter than the vertical length of the wall surfaces 86 of the discharge outlet 84 and the upper surface of the beam member 88 being flush with the passage chamber 64A does not occur.

In the second exemplary embodiment, the rectangular through holes 172D, which cause a chunk of toner T passing therethrough to be broken down, are formed. However, it is sufficient that passing a chunk of toner T through the through holes cause the chunk of toner T to be broken down, and for instance, the through holes may have another shape such as a circular shape.

In the second exemplary embodiment, the opening area of each through hole 172D is set to be equal to or smaller than the opening area of the discharge outlet 84. However, the opening area of the through hole 172D may be greater than the opening area of the discharge outlet 84. However, in this case, an operation achieved by the opening area of the through hole 172D being equal to or smaller than the opening area of the discharge outlet 84 does not occur.

In the first and second exemplary embodiments, the inclined surface 76A is formed in each rod section 76. However, the inclined surface 76A may not be formed in each rod section 76.

In the first and second exemplary embodiments, the partition section 72 is rotated. However, a configuration may be adopted in which the partition section 72 is not rotated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder material storage container comprising:

a body member that has a cylindrical shape extending in one direction and that includes a storage chamber configured to store powder material;

a transport member configured to transport the powder material stored in the storage chamber of the body member to an end of the storage chamber;

an end member that is attached to an end of the body member, and that has a cylindrical shape extending in the one direction and includes a passage chamber configured to pass the powder material transported by the transport member to be discharged to an outside, and a discharge outlet which is formed in a wall surface of the passage chamber, wherein the discharge outlet is configured to discharge the powder material to an outside of the powder material storage container;

a pillar member that is disposed in the passage chamber and extends in the one direction, and that is configured to rotate in a circumferential direction of the passage chamber along the wall surface of the passage chamber, and that is configured to transport the powder material adhering to the wall surface of the passage chamber to the discharge outlet; and a rigid beam member that is laid across the discharge outlet and extends from an upstream side to a downstream side of a rotation direction of the pillar member.

2. The powder material storage container according to claim 1, wherein the discharge outlet is surrounded by a wall surface, wherein a vertical length of the beam member is set to be shorter than a vertical length of the wall surface, and wherein an upper surface of the beam member is flush with the passage chamber.

3. An image forming apparatus comprising:

the powder material storage container according to claim 2;

an image carrier configured such that an electrostatic latent image may be formed on the image carrier; and a developing device configured to receive the powder material to be stored in the powder material storage container, and configured to develop the electrostatic latent image formed in the image carrier with the powder material.

4. The powder material storage container according to claim 2, further comprising a partition section that partitions into the storage chamber and the passage chamber, wherein a through hole having an opening area equal to or smaller than an opening area of the discharge outlet is formed in the partition section.

5. An image forming apparatus comprising:

the powder material storage container according to claim 4;

an image carrier configured such that an electrostatic latent image may be formed on the image carrier; and a developing device configured to receive the powder material to be stored in the powder material storage container, and configured to develop the electrostatic latent image formed in the image carrier with the powder material.

6. The powder material storage container according to claim 1, further comprising a partition section that partitions into the storage chamber and the passage chamber, wherein a through hole having an opening area equal to or smaller than an opening area of the discharge outlet is formed in the partition section.

7. An image forming apparatus comprising:

the powder material storage container according to claim 6;

an image carrier configured such that an electrostatic latent image may be formed on the image carrier; and a developing device configured to receive the powder material to be stored in the powder material storage container, and configured to develop the electrostatic latent image formed in the image carrier with the powder material.

8. An image forming apparatus comprising:

the powder material storage container according to claim 1;

an image carrier configured such that an electrostatic latent image may be formed on the image carrier; and a developing device configured to receive the powder material to be stored in the powder material storage container, and configured to develop the electrostatic latent image formed in the image carrier with the powder material.

9. A powder material storage container comprising:

a body member that has a cylindrical shape extending in one direction and that includes a storage chamber configured to store powder material;

a transport member configured to transport the powder material stored in the storage chamber of the body member to an end of the storage chamber;

an end member that is attached to an end of the body member, and that has a cylindrical shape extending in the one direction and includes a passage chamber configured to pass the powder material transported by the transport member to be discharged to an outside, and a discharge outlet which is formed in a wall surface of the passage chamber, wherein the discharge outlet is configured to discharge the powder material to an outside of the powder material storage container;

a pillar member that is disposed in the passage chamber and extends in the one direction, and that is configured to rotate in a circumferential direction of the passage chamber along the wall surface of the passage chamber, and that is configured to transport the powder material adhering to the wall surface of the passage chamber to the discharge outlet; and a beam member that is laid across the discharge outlet and extends from an upstream side to a downstream side of a rotation direction of the pillar member, wherein the discharge outlet is surrounded by a wall surface, wherein a vertical length of the beam member is set to be shorter than a vertical length of the wall surface, and wherein an upper surface of the beam member is flush with the passage chamber.

10. A powder material storage container comprising:

a body member that has a cylindrical shape extending in one direction and that includes a storage chamber configured to store powder material;

a transport member configured to transport the powder material stored in the storage chamber of the body member to an end of the storage chamber;

an end member that is attached to an end of the body member, and that has a cylindrical shape extending in the one direction and includes a passage chamber configured to pass the powder material transported by the transport member to be discharged to an outside, and a discharge outlet which is formed in a wall surface of the passage chamber, wherein the discharge outlet is configured to discharge the powder material to an outside of the powder material storage container;

a pillar member that is disposed in the passage chamber and extends in the one direction, and that is configured to rotate in a circumferential direction of the passage chamber along the wall surface of the passage chamber, and that is configured to transport the powder material adhering to the wall surface of the passage chamber to the discharge outlet; and a beam member that is laid across the discharge outlet and extends from a first end at an upstream side to a second end at a downstream side of a rotation direction of the pillar member, wherein both of the first end and the second end are fixed to a wall surface of the discharge outlet.

* * * * *